US006955635B2

(12) United States Patent
Chelekis

(10) Patent No.: US 6,955,635 B2
(45) Date of Patent: Oct. 18, 2005

(54) EXERCISE APPARATUS

(75) Inventor: Eric Glen Chelekis, Suwanee, GA (US)

(73) Assignee: Chelekis Enterprises, Inc., Norcross, GA (US)

( * ) Notice: Subject to any disclaimer, the term of this patent is extended or adjusted under 35 U.S.C. 154(b) by 62 days.

(21) Appl. No.: 10/211,114

(22) Filed: Jul. 22, 2002

(65) Prior Publication Data

US 2003/0017924 A1 Jan. 23, 2003

Related U.S. Application Data

(60) Provisional application No. 60/306,773, filed on Jul. 21, 2001, and provisional application No. 60/306,775, filed on Jul. 21, 2001.

(51) Int. Cl.[7] ..... A63B 71/00
(52) U.S. Cl. ..... 482/140
(58) Field of Search ..... 482/51, 79, 80, 482/140, 148, 142

(56) References Cited

U.S. PATENT DOCUMENTS 4,752,067 A * 6/1988 Colonello ..... 482/140
5,584,786 A * 12/1996 Almeda ..... 482/142
5,813,957 A * 9/1998 Rossiter ..... 482/140

* cited by examiner

*Primary Examiner*—Stephen R. Crow
(74) *Attorney, Agent, or Firm*—Powell Goldstein, LLP; Jason A. Bernstein; Charles L. Warner, II

(57) ABSTRACT

An apparatus for exercising the gluteus maximus comprising a body section curved to support the lower, middle and upper back and neck areas, a cam associated with the underside of the body for permitting the user to rock from a resting to a full extension position, and, a pair of shoulder members extending outward from said body and curved slightly toward the lower part of the body section to retain the shoulders on the apparatus when in use.

6 Claims, 3 Drawing Sheets

EXERCISE APPARATUS

CROSS-REFERENCE TO RELATED APPLICATION

This application claims priority of provisional application No. 60/306,773, filed Jul. 21, 2001, now abandoned, entitled Bunn Cruncher II and provisional application No. 60/306,775, filed Jul. 21, 2001, now abandoned, entitled Bunn Cruncher I, the disclosures of which are incorporated by reference in their entirety herein.

FIELD OF THE INVENTION

The present invention relates to exercise equipment and, more particularly, to a nonpowered apparatus for assisting a user in exercising the gluteus maximus area of the body.

BACKGROUND OF THE INVENTION

Exercise equipment has been designed for isolated exercise of various muscle groups. Exercising the gluteus maximus (buttock) area is often desired, but, users can either hyperextend the back if not careful or otherwise strain the area because known equipment is not adequately designed to accommodate the spinal curvature of the body. Improper support of non-exercised areas also accounts for improper form for exercising and can lead to risk of strain. Therefore, there is a need for a piece of exercise equipment that would facilitate exercise of the buttock area while minimizing risk of strain.

SUMMARY OF THE INVENTION

An apparatus for exercising the gluteus maximus comprising a body section curved to support the lower, middle and upper back and neck areas, a cam associated with the underside of the body for permitting the user to rock from a resting to a full extension position, and, a pair of shoulder members extending outward from said body and curved slightly toward the lower part of the body section to retain the shoulders on the apparatus when in use.

In one embodiment the apparatus uses a single cam member for support. In a second embodiment the single cam is replaced with a pair of cam members disposed on either side of the body section.

More particularly, in one embodiment, the present invention comprises a body having a top surface, a bottom surface, a left side and a right side and having a curved first section for supporting the lower back of a user, a curved second section for supporting the shoulder and middle back area of a user, and a curved third section for supporting the upper back and neck area of a user; a pair of cam members associated with the bottom surface of the body; a shoulder member extending outward from the left side of the body and curving toward the first section; and, a shoulder member extending outward from the right side of the body and curving toward the first section.

Other features and advantages of the present invention will become apparent upon reading the following detailed description of embodiments of the invention, when taken in conjunction with the appended claims.

BRIEF DESCRIPTION OF THE DRAWINGS

The invention is illustrated in the drawings in which like reference characters designate the same or similar parts throughout the figures of which.

DETAILED DESCRIPTION OF THE INVENTION

Figure 1:
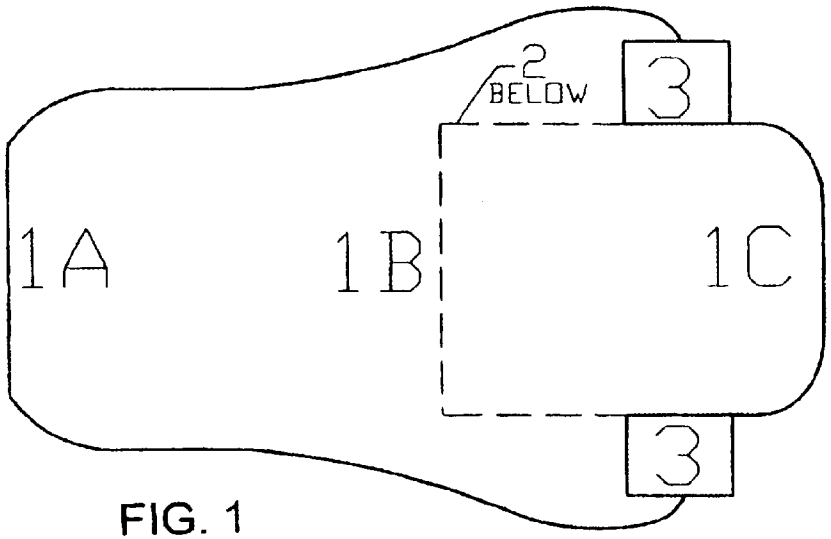
FIG. 1 is a top plan view of one a first embodiment of the present invention.
Figure 2:
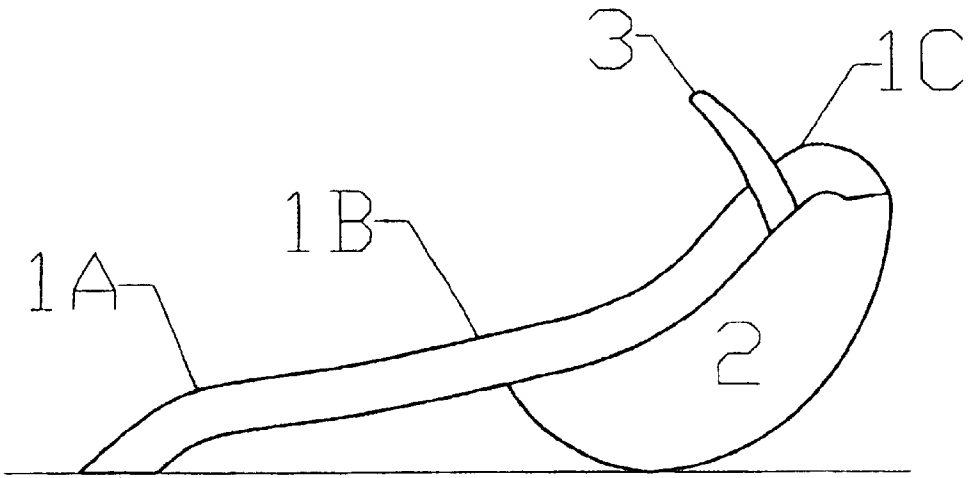
FIG. 2 is a side elevational view of a first embodiment of the present invention.
Figure 3:
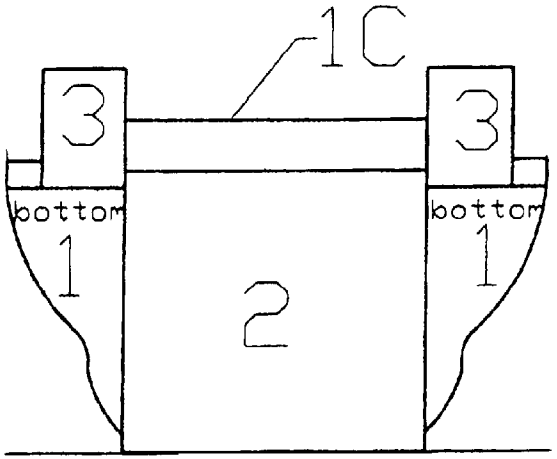
FIG. 3 is an end elevational view of a first embodiment of the present invention.

The present invention provides an apparatus to exercise the gluteus maximus area (as well as hamstrings and thighs) of the human body. In a first embodiment, shown in FIGS. 1–3, the apparatus generally comprises a body 1, a cam 2, and shoulders 3. The body 1 is a curved surface, which consists of three curves: 1A, 1B, and 1C. The three curves are designed to fit to the curves of the human spine when a person lays onto the body of the unit. The cam 2 attaches, or is attached (depending on the production technique used, to the bottom of the body 1 and is curved to act as a rocker for the unit. The shoulders 3 extend outward from the top of the body 1 to the sides of the 1C curve, and are angled slightly down toward the end of the body 1A. The shoulders 3 are slightly concave to the front, which helps to support the body while using the apparatus.

Figure 6:
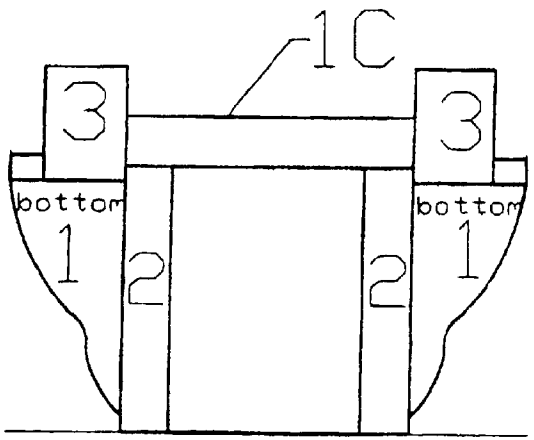
FIG. 6 is an end elevational view of a second embodiment of the present invention.
Figure 4:
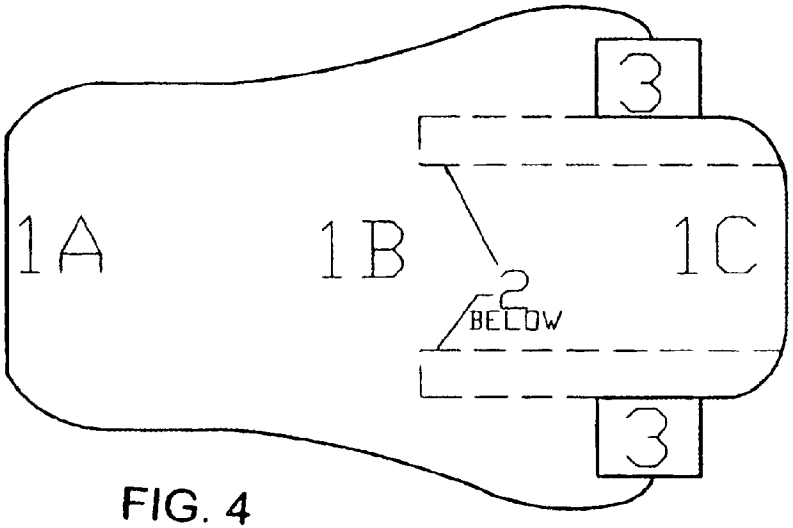
FIG. 4 is a top plan view of a second embodiment of the present invention.
Figure 5:
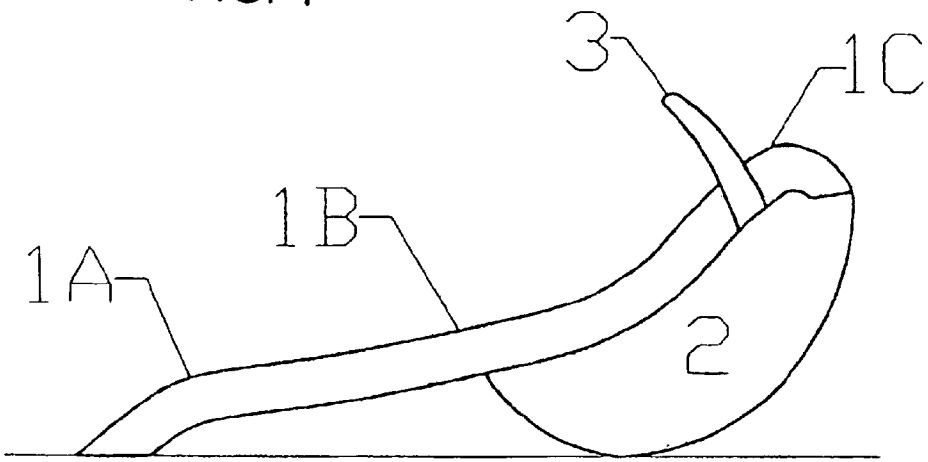
FIG. 5 is a side elevational view of a second embodiment of the present invention.

In a second embodiment, shown in FIGS. 4–6, the same basic design as the first embodiment is utilized, but in this embodiment the cam 2 comprises two cam members 2 (best seen in FIG. 6) with a space between them rather than the single surface cam 2 of the first embodiment. In this embodiment two cam members 2 may reduce the overall weight and material costs of the apparatus while providing adequate strength and support.

Figure 7:
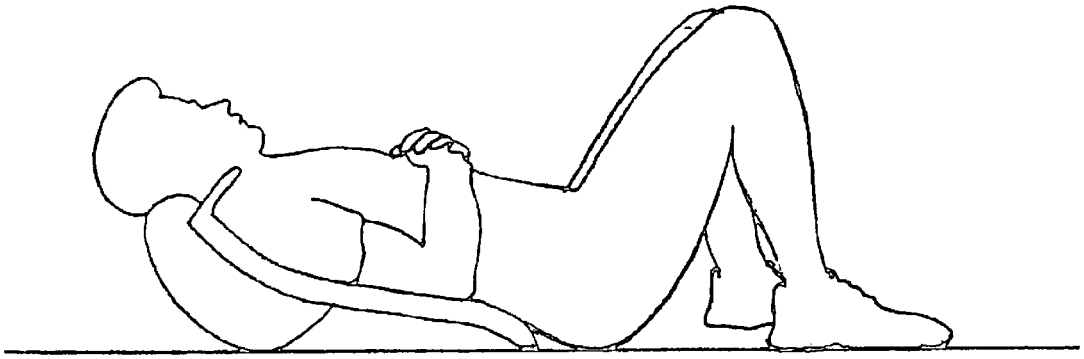
FIG. 7 is a schematic view of the apparatus of either embodiment shown with a user in the "at rest" position.
Figure 8:
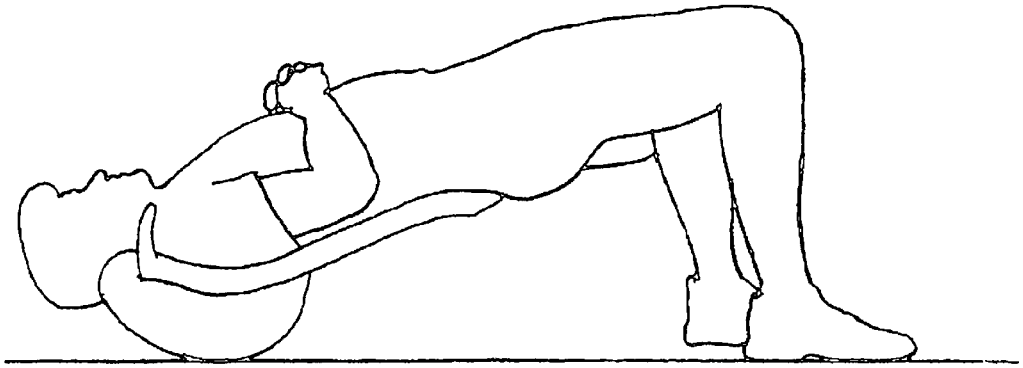
FIG. 8 is a schematic view of the apparatus of either embodiment shown with a user in the "full extension" position.

To use the product, a person lays their back onto the body 1 of the unit with their neck at the 1C curve and their lower back at the 1A curve (see FIGS. 7–8). The person's shoulders are pressed against the concave side of the shoulders 3 to properly position the person on the unit. The person then bends their knees, placing their feet flat on the floor, as close to their butt as possible. The arms can be folded on their stomach or the hands can grip the shoulders 3 for support. The movement is done by pressing the feet to the floor, raising the hips into the air, and causing the unit to rock backwards and up onto the cam 2. Once the person has reached the limit of their range of motion, they slowly lower their hips back to the floor and start over again. This movement causes contraction of the gluteus maximus, as well as the hamstrings and thighs, thus strengthening and toning these muscle groups.

The apparatus of the present invention is preferably made of molded plastic or other rigid material. It can be produced in any of the different plastic thermal-forming processes, depending upon the size of the production runs and the type of material to be used. Two possible processes are multi-cavity twin-sheet forming and injection molding, both of which require aluminum and/or steel molds. As far as the types of plastic that can be used in the process, the whole spectrum of suitable thermal plastics can be used. It all depends on the structural engineering of the final design. The apparatus is designed to hold a weight of over 300 lbs. One manufacturing process may use a "twin-sheet former" and high-density polyethylene.

The color of the apparatus can be any possible color. a self-adhesive rubber strip can applied to the cam 2 where it touches the floor to ensure better traction when used on low-friction surfaces.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. An exercise apparatus, comprising:

a) a body having a top surface, a bottom surface, a left side and a right side, the body having i) a curved first section located at one end of the body of the device and, in use, is adjacent to the lower back area of a user, ii) a curved second section located toward the center of the body of the device, and, in use, is adjacent to the middle back area of the user iii) a curved third section located at the distal end of the body of the device and, in use, is adjacent to the upper back area of the user;

b) at least one cam member associated with at least said curved third section, extending downwardly from said bottom surface of said body, and situated under the upper back area of the user;

c) a first shoulder member extending upwardly from the top surface of the curved third section on said left side of said body and, in use, contacting a first shoulder of the user; and, d) a second shoulder member extending upwardly from the top surface of the curved third section on said right side of said body and, in use, contacting a second shoulder of the user;

the first and second shoulder members engaging the shoulders of the user, thereby preventing the user from sliding longitudinally along the body of the device when the user is causing the device to rotate along the cam member so that the curved first section is elevated.

2. An exercise apparatus, comprising:

a) a body having a top surface, a bottom surface, a left side and a right side, the body having i) a curved first section located at one end of the body of the device and, in use, is adjacent to the lower back of a user, ii) a curved second section located toward the center of the body of the device and, in use, is adjacent to the middle back area of the user, iii) a curved third section located at the distal end of the body of the device and, in use, is adjacent to the upper back area of the user;

b) a pair of cam members associated with at least said curved third section, extending downwardly from said bottom surface of said body, and situated under the upper back area of the user;

c) a first shoulder member extending upwardly from the top surface of the curved third section on said left side of said body; and, d) a second shoulder member extending upwardly from the top surface of the curved third section on said right side of said body;

the first and second shoulder members engaging the shoulders of the user, thereby preventing the user from sliding longitudinally along the body of the device when the use is causing the device to rotate on the pair of cam members so that the curved first section is elevated.

3. The apparatus of claim 2, further comprising a friction enhancing material associated with a portion of said cam members that will come in contact with a floor or other surface.

4. The apparatus of claim 2, wherein each said shoulder member also curves toward said curved first section.

5. The apparatus of claim 1, wherein each said shoulder member also curves toward said first section.

6. The apparatus of claim 1, further comprising a friction enhancing material associated with a portion of said cam member that will come in contact with a floor or other surface.

* * * * *